US008627633B2

(12) United States Patent
Davies

(10) Patent No.: US 8,627,633 B2
(45) Date of Patent: Jan. 14, 2014

(54) PORTABLE MODULAR ROOF TRUSS SYSTEM

(75) Inventor: Charles J. Davies, Pasadena, CA (US)

(73) Assignee: Global Truss America, LLC, Los Angeles, CA (US)

( * ) Notice: Subject to any disclaimer, the term of this patent is extended or adjusted under 35 U.S.C. 154(b) by 209 days.

(21) Appl. No.: 12/822,521

(22) Filed: Jun. 24, 2010

(65) Prior Publication Data

US 2010/0326003 A1 Dec. 30, 2010

Related U.S. Application Data

(60) Provisional application No. 61/269,586, filed on Jun. 26, 2009.

(51) Int. Cl.
*E04H 12/00* (2006.01)

(52) U.S. Cl.
USPC ..... 52/653.2; 52/641; 52/643; 52/646

(58) Field of Classification Search
USPC ..... 52/633, 641, 648.1, 650.3, 652.1, 52/653.2, 655.1, 690, 643, 645, 646, 52/650.1; 135/120.3, 909, 121, 122, 160
See application file for complete search history.

(56) References Cited

U.S. PATENT DOCUMENTS

| | | | | |
|---|---|---|---|---|
| 1,181,013 | A * | 4/1916 | Inglis | 14/4 |
| 1,420,670 | A * | 6/1922 | Schuette | 403/292 |
| 1,568,099 | A * | 1/1926 | Strauss | 52/641 |
| 1,837,374 | A * | 12/1931 | Samuel | 52/652.1 |
| 1,840,745 | A * | 1/1932 | Shoaf | 135/98 |
| 2,187,436 | A * | 1/1940 | Thofehrn et al. | 135/122 |

(Continued)

FOREIGN PATENT DOCUMENTS

| | | | |
|---|---|---|---|
| FR | 2826990 | | 1/2003 |
| FR | 2826990 | A1 | 1/2003 |
| WO | 2010151882 | A1 | 12/2010 |
| WO | 2011163015 | A1 | 12/2011 |

OTHER PUBLICATIONS

International Search Report and Written Opinion dated Oct. 21, 2011 for International Application No. PCT/US2011/040371 from International Searching Authority/US, pp. 1-13, Alexandria, Virginia, United States.

(Continued)

*Primary Examiner* — William Gilbert
*Assistant Examiner* — James Ference
(74) *Attorney, Agent, or Firm* — Kenneth L. Sherman, Esq.; Michael Zarrabian, Esq.; Sherman & Zarrabian LLP

(57) ABSTRACT

The present invention provides a portable modular roof truss system for creating a symmetric roof. In one embodiment, the portable modular roof truss system comprises a collar, a crossbar, two arms, two connecting members, and a locking mechanism. The arms are elongated hollow cylinders coupled to opposing sides of the hollow cylindrical collar at a predetermined slope. The crossbar is also an elongated cylinder residing parallel to the ground and is coupled to both arms. Each hollow cylindrical connecting member is coupled to the end of an arm, respectively. Finally, the locking mechanism is coupled to the bottom portion of the collar and prevents a roof pole residing therein from moving back and forth. Each connecting member further comprises two apertures residing on opposite sides of the member used to couple the truss system to a variety of truss components (e.g., spacers, clamps, hinges, etc.).

27 Claims, 9 Drawing Sheets

(56) References Cited

U.S. PATENT DOCUMENTS

| | | | | | |
|---|---|---|---|---|---|
| 2,201,504 | A | * | 5/1940 | Ruppel | 52/635 |
| 2,334,435 | A | * | 11/1943 | Patterson et al. | 135/122 |
| 2,693,195 | A | * | 11/1954 | Frieder et al. | 135/122 |
| 2,764,107 | A | * | 9/1956 | Niswonger et al. | 52/643 |
| 2,826,990 | A | * | 3/1958 | Gross | 102/424 |
| 2,845,078 | A | * | 7/1958 | Singleton | 135/121 |
| 2,897,831 | A | * | 8/1959 | Liden | 135/160 |
| 2,936,186 | A | | 5/1960 | Dunmire | |
| 3,058,549 | A | * | 10/1962 | Anderson | 52/127.1 |
| 3,062,340 | A | * | 11/1962 | Hunnebeck | 52/646 |
| 3,114,377 | A | * | 12/1963 | Clement | 135/160 |
| 3,172,507 | A | * | 3/1965 | Blyveis | 52/698 |
| 3,296,752 | A | * | 1/1967 | Philp | 52/70 |
| 3,303,851 | A | * | 2/1967 | Grunfeld | 135/155 |
| 3,383,127 | A | * | 5/1968 | Grunfeld | 403/173 |
| 3,418,768 | A | * | 12/1968 | Cardan | 52/167.1 |
| 3,424,178 | A | * | 1/1969 | Yoshimi | 135/157 |
| 3,436,881 | A | * | 4/1969 | Schlecht | 52/91.3 |
| 3,441,037 | A | * | 4/1969 | Transeau | 135/97 |
| 3,456,415 | A | * | 7/1969 | Shaffer | 52/694 |
| 3,582,029 | A | | 6/1971 | Moesta | |
| 3,766,573 | A | * | 10/1973 | Burkholz et al. | 4/498 |
| 3,925,942 | A | * | 12/1975 | Hemmelsbach | 52/86 |
| 4,030,256 | A | * | 6/1977 | Ollman | 52/93.1 |
| 4,246,730 | A | * | 1/1981 | Hulscher | 52/263 |
| 4,641,477 | A | * | 2/1987 | Schleck | 52/646 |
| 4,653,782 | A | * | 3/1987 | Munday | 285/373 |
| 4,683,901 | A | * | 8/1987 | Mitchell | 135/97 |
| 4,769,962 | A | * | 9/1988 | Pohl et al. | 52/273 |
| 4,878,286 | A | * | 11/1989 | Coppa | 29/467 |
| 4,961,297 | A | * | 10/1990 | Bernard | 52/93.1 |
| 5,076,031 | A | * | 12/1991 | Hancock | 52/63 |
| 5,078,534 | A | * | 1/1992 | White | 403/292 |
| 5,159,790 | A | * | 11/1992 | Harding | 52/86 |
| 5,167,246 | A | * | 12/1992 | Mortenson | 135/153 |
| 5,205,101 | A | * | 4/1993 | Swan et al. | 52/650.1 |
| 5,309,693 | A | * | 5/1994 | Harding | 52/745.08 |
| 5,388,376 | A | * | 2/1995 | Demeyer | 52/6 |
| 5,584,311 | A | * | 12/1996 | Schaefer | 135/128 |
| 5,592,789 | A | * | 1/1997 | Liddell et al. | 52/63 |
| 5,623,786 | A | * | 4/1997 | DeMeyer | 52/6 |
| 5,660,002 | A | * | 8/1997 | Lashinger | 52/63 |
| 5,822,945 | A | * | 10/1998 | Muller | 52/646 |
| 5,826,384 | A | * | 10/1998 | O'Neill | 52/223.9 |
| 5,964,068 | A | * | 10/1999 | O'Neill | 52/223.9 |
| 6,026,626 | A | * | 2/2000 | Fisher | 52/633 |
| 6,065,267 | A | * | 5/2000 | Fisher | 52/692 |
| 6,076,770 | A | * | 6/2000 | Nygren et al. | 244/159.5 |
| 6,079,178 | A | * | 6/2000 | Fisher | 52/690 |
| 6,082,068 | A | * | 7/2000 | Fisher | 52/633 |
| 6,170,503 | B1 | * | 1/2001 | Lin Shy | 135/119 |
| 6,212,850 | B1 | * | 4/2001 | Branson | 52/745.01 |
| 6,321,501 | B1 | * | 11/2001 | Ignash | 52/645 |
| 6,609,343 | B1 | | 8/2003 | Litten | |
| 6,618,988 | B2 | * | 9/2003 | Williams et al. | 47/17 |
| 6,626,605 | B1 | * | 9/2003 | Dean et al. | 403/344 |
| 6,675,546 | B2 | * | 1/2004 | Coles | 52/655.1 |
| 6,691,488 | B2 | * | 2/2004 | Branson | 52/745.01 |
| 6,832,448 | B2 | * | 12/2004 | Stefan | 47/17 |
| 7,275,555 | B2 | * | 10/2007 | Powell et al. | 135/122 |
| 7,690,698 | B1 | | 4/2010 | Curran | |
| 7,770,591 | B2 | * | 8/2010 | Tseng | 135/122 |
| 7,963,084 | B2 | * | 6/2011 | Merrifield et al. | 52/646 |
| 7,988,386 | B2 | * | 8/2011 | Sisk | 406/127 |
| 8,006,462 | B2 | * | 8/2011 | Murphy et al. | 52/645 |
| 8,011,162 | B2 | * | 9/2011 | Overby | 52/745.17 |
| 8,028,488 | B2 | * | 10/2011 | Dodd | 52/645 |
| 2001/0015047 | A1 | * | 8/2001 | Branson | 52/745.01 |
| 2002/0170588 | A1 | * | 11/2002 | Seo | 135/90 |
| 2003/0005953 | A1 | * | 1/2003 | Erbetta et al. | 135/151 |
| 2003/0041548 | A1 | * | 3/2003 | Merrifield | 52/646 |
| 2004/0035454 | A1 | * | 2/2004 | Tseng | 135/121 |
| 2004/0118443 | A1 | * | 6/2004 | Powell et al. | 135/122 |
| 2005/0126106 | A1 | * | 6/2005 | Murphy et al. | 52/652.1 |
| 2005/0204681 | A1 | * | 9/2005 | Zeigler | 52/646 |
| 2006/0090786 | A1 | * | 5/2006 | Lapping | 135/121 |
| 2006/0107611 | A1 | * | 5/2006 | Merrifield | 52/646 |
| 2008/0078139 | A1 | * | 4/2008 | Overby | 52/646 |
| 2008/0178555 | A1 | * | 7/2008 | Green et al. | 52/690 |

OTHER PUBLICATIONS

Notification of Transmittal of the International Search Authority, International Search Report and the Written Opinion mailed Sep. 1, 2010 for International Application No. PCT/US2010/040227 from Commissioner for Patents, filed Jun. 28, 2010, pp. 1-9, Alexandria, Virginia, United States.

International Preliminary Report on Patentability dated Jan. 10, 2013 for International Application No. PCT/US2011/04371 from International Bureau of WIPO, pp. 1-12, Geneva, Switzerland.

U.S. Non-Final Office Action for U.S. Appl. No. 13/806,735 mailed Aug. 22, 2013.

International Preliminary Report on Patentability and Written Opinion dated Jan. 12, 2012 for International Application No. PCT/US2010/040227 from International Bureau of WIPO, pp. 1-7, Geneva, Switzerland.

* cited by examiner

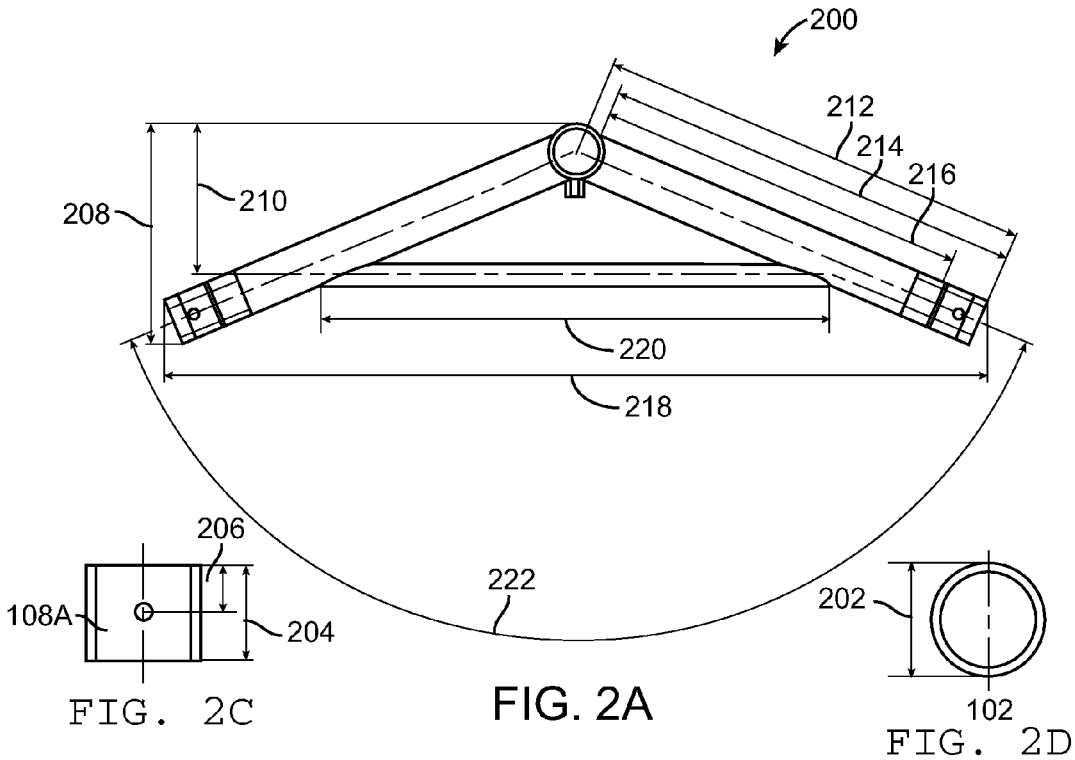
FIG. 2C
FIG. 2A
FIG. 2D
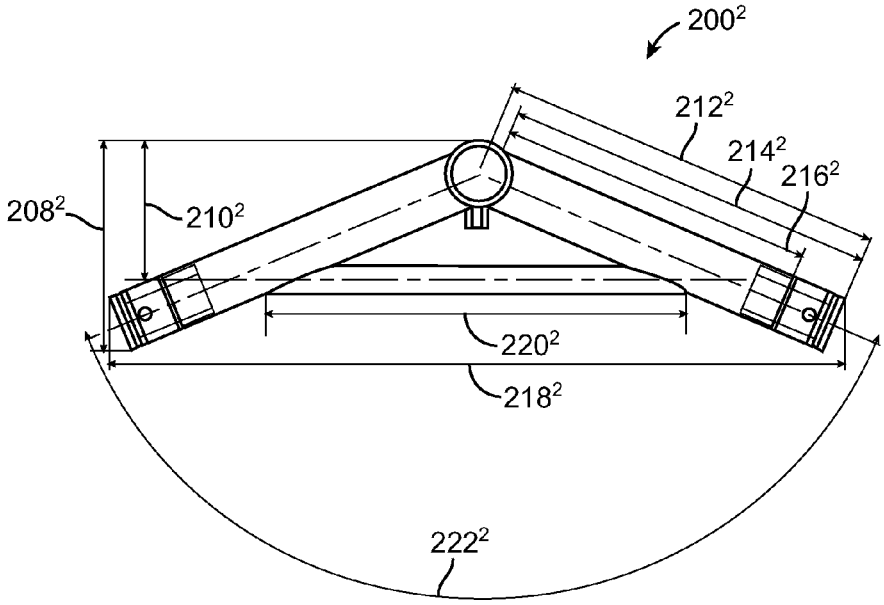
FIG. 2B

PORTABLE MODULAR ROOF TRUSS SYSTEM

CROSS REFERENCE TO RELATED APPLICATIONS

Pursuant to 35 U.S.C. §119(e), this application claims priority to U.S. Provisional Patent Application Ser. No. 61/269,586 filed Jun. 26, 2009, incorporated herein by reference in its entirety.

BACKGROUND OF THE INVENTION

1. Field of the Invention

The present invention relates generally to truss systems, and in particular, to a portable modular roof truss system.

2. Description of Related Art

Trusses provide general purpose skeletal structures designed to support lighting and audio equipment for live stages, theatres, night clubs, church installations, and other mobile applications. Trusses generally include a variety of different modular truss elements or members that can be interconnected to build structures of different shapes and forms by a designer to independently create whichever lighting, audio or other affect or appearance may be desired.

Typically, each of the truss members are modular and can be connected together and dismantled quickly. The modular members may include square truss members, triangular truss members, I-beam truss members, clamps, box truss members, circular truss members, lifts/lifters, junction blocks, truss corners, towers, sleeve blocks, couplers and clamps among others. The truss members generally run about 0.5 meters in length and are either straight lengths or circular arcs and have connectors to mate the members together.

Oftentimes the same structure must be recreated many times in different places. For example, in a rock and roll touring show the truss work and stage effects must be created and recreated in different places along the tour. On other occasions, the structures are created once and then dismantled. For example, a trade show or political convention will be designed in a particular manner for a particular venue and for an audience at the venue. Then, once the show or convention is complete, the trusses are dismantled and the members are reused in other applications later. In any case, once the trusses are in place they must also be strong and permanent for usage without concerns about the structural performance when they are in place.

BRIEF SUMMARY OF THE INVENTION

Embodiments of the present invention provide a portable modular roof truss system for assembling a roof, such as a symmetric roof, from truss members. In one embodiment, the portable modular roof truss system comprises a collar, a crossbar, two arms, two connecting members, and a locking mechanism. The arms are elongated hollow cylinders coupled to opposing sides of the hollow cylindrical collar at a predetermined slope. The crossbar is also an elongated cylinder residing parallel to the ground and is coupled to both arms. Each hollow cylindrical connecting member is coupled to the end of an arm, respectively. Finally, the locking mechanism is coupled to the bottom portion of the collar and prevents a roof pole residing therein from moving back and forth. Each connecting member further comprises two apertures residing on opposite sides of the member used to couple the truss system to a variety of truss components (e.g., spacers, clamps, hinges, etc.).

In another embodiment, the portable modular roof truss system comprises two collars, a crossbar, four arms, four connecting members, two locking mechanisms, and a plurality of filler bars. The arms are elongated hollow cylinders coupled (e.g., welded) to opposing sides of the hollow cylindrical collars. The crossbar is also an elongated cylinder residing parallel to the ground and is coupled (e.g., welded) to both bottom arms. Each hollow cylindrical connecting member is coupled (e.g., welded) to the end of an arm, respectively. The locking mechanisms are coupled (e.g., welded) to the bottom portion of the collars. Finally, the filler bars are elongated hollow cylinders coupled (e.g., welded) to two arms residing on one side of both collars.

Roof poles pass through the hollow cylindrical collars of the truss system. Said roof poles may pass through a plurality of modular roof truss systems to create a roof of desired length while maintaining a fixed slope.

These and other features, aspects and advantages of the present invention will become understood with reference to the following description, appended claims and accompanying figures.

BRIEF DESCRIPTION OF THE DRAWINGS

FIG. 2A illustrates a front view of a first portable modular roof truss system, according to an embodiment of the present invention.

FIG. 2B illustrates a front view of a second portable modular roof truss system, according to an embodiment of the present invention.

FIG. 2C illustrates an isolated view of a radius and diameter of connecting members for the second portable modular roof truss system shown in FIGS. 2A-B, according to an embodiment of the present invention.

FIG. 2D illustrates an isolated view of a diameter of a collar for the second portable modular roof truss system shown in FIGS. 2A-B, according to an embodiment of the present invention.

DETAILED DESCRIPTION OF THE INVENTION

The following description is made for the purpose of illustrating the general principles of the present invention and is not meant to limit the inventive concepts claimed herein. Further, particular features described within can be used in combination with other described features in each of the various possible combinations and permutations. Unless otherwise specifically defined herein, all terms should be given their broadest possible interpretation including meanings implied from the specification as well as meanings understood by those skilled in the art and/or as defined in dictionaries, treatises, etc.

Figure 1:
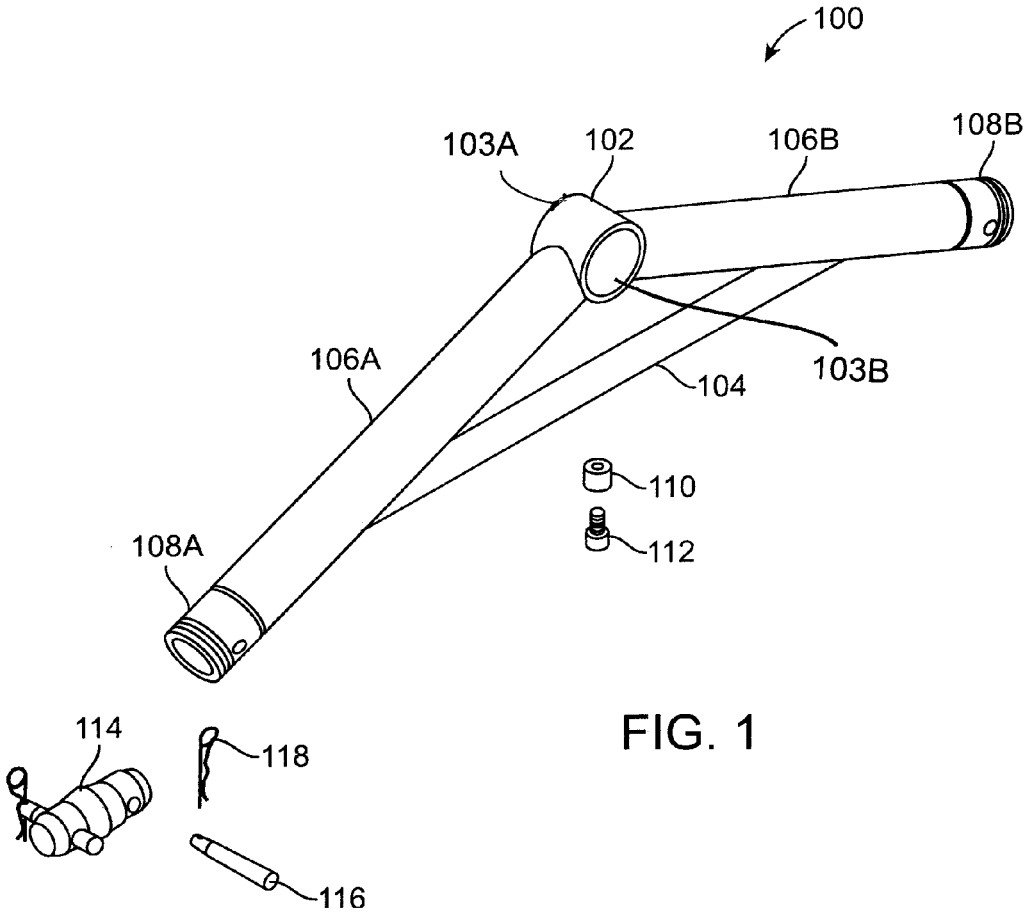
FIG. 1 illustrates a perspective view of a portable modular roof truss system, according to an embodiment of the present invention.

FIG. 1 illustrates a perspective view of a portable modular roof truss system 100, according to an embodiment of the present invention. The portable modular roof truss system 100 comprises a collar 102, a crossbar 104, two arms 106A, 106B, two connecting members 108A, 108B, and a locking mechanism comprising a nut 110 and bolt 112. The arms 106A, 106B, are elongated hollow cylinders coupled (e.g., welded) to opposing sides of the hollow cylindrical collar 102 at a predetermined slope. The hollow cylindrical collar 102 includes a first open end 103A and a second open end 103B. The crossbar 104 is also an elongated cylinder residing parallel to the ground and is coupled (e.g., welded) to both arms 106A, 106B. Each hollow cylindrical connecting member 108A, 108B, is coupled (e.g., welded) to the end of an arm 106A, 106B, respectively. Finally, the nut 110 from the locking mechanism is coupled (e.g., welded) to the bottom portion of the collar 102 and interfaces an aperture in the collar 102 allowing the bolt 112 to pass through the nut 110 and into the hollow portion of the collar 102. Those skilled in the art will appreciate that the locking mechanism may alternatively reside on the top of the collar 102. Each connecting member 108A, 108B, further comprises two apertures residing on opposite sides of the member perpendicular to the hollow portion of the member used to couple the truss system 100 to a coupler 114. The connecting members 108A, 108B, are capable of coupling to a variety of truss components (e.g., spacers, clamps, hinges, etc.). While the collar, arms, and crossbar mentioned herein are cylindrical in shape, the collar, arms, and crossbar may have different profiles such as elliptical, rectangular, etc.

For example, a coupler 114 may be inserted into the hollow portion of a connecting member 108A; a locking pin 116 may then be inserted through the apertures in the connecting member 108A and in turn through an aperture in the coupler 114. In one embodiment, the locking pin 116 comprises a tapered cylinder with an aperture at smaller end capable of receiving a clasp 118. When the clasp 118 passes through the aperture in the locking pin 116, the coupler 114 is removably coupled to the portable modular roof truss system 100 at the connecting member 108A. The coupler 114 may further removably couple to additional truss components (e.g., I-beam truss segment, straight segment, etc.).

FIG. 2A illustrates a front view of a first portable modular roof truss system 200, according to an embodiment of the present invention. The height 208 of the truss system 200, when measured from the bottom edge of the connecting member to the top of the collar is between 215 cm to 225 cm, and preferably 219.8 cm. The height 210 when measured from the top edge of the connecting member to the top of the collar 102 is between 145 cm to 155 cm, and is preferably 150 cm. The length 212 of an arm and connecting member coupled to the collar 102, when measured from the center of the collar 102 to the bottom edge of the connecting member, is between 430 cm to 440 cm, and preferably 435 cm. The length 214 as measured from the top edge of an arm to the bottom edge of a connector member is between 415 cm to 421 cm, and preferably 418.4 cm. Length 216 of the arm alone is preferably 368.4 cm. The length 220 of the crossbar is between 500 cm to 510 cm, and preferably 506 cm with a 1 cm delta. The width 218 of the portable modular roof truss system 200 is between 815 cm to 825 cm, and preferably 821.1 cm. Finally, the angle 222 as measured between the midline of both connector members and through the center of the collar is between 130° to 140°, and preferably 134.8°.

Figure 8:
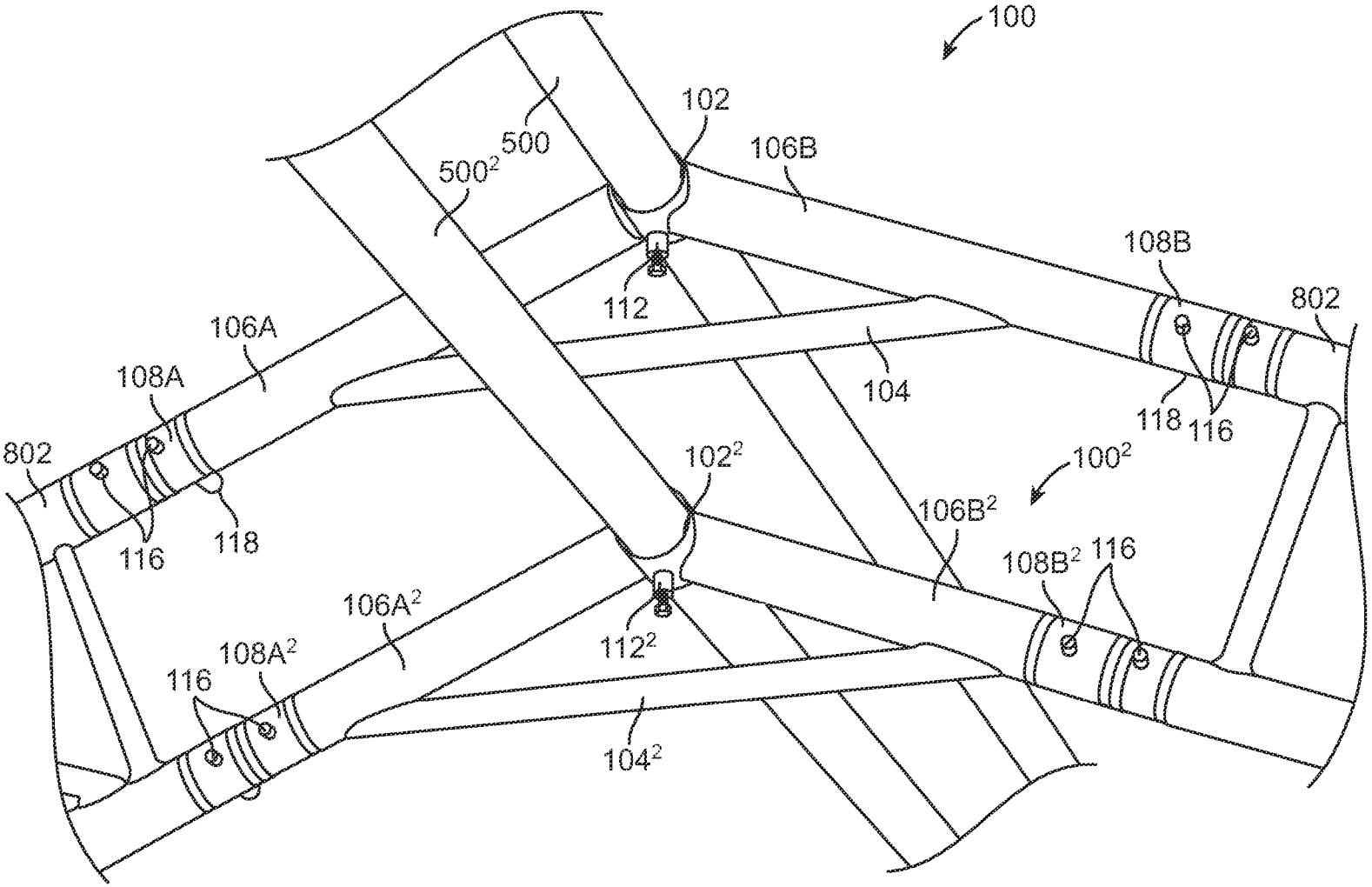
FIG. 8 illustrates a view of assembled modular roof truss systems, according to an embodiment of the present invention.

FIG. 2B illustrates a front view of a second portable modular roof truss system 200$^2$, according to an embodiment of the present invention. In one embodiment, the first truss system 200 and the second truss system 200$^2$ are employed to couple to an I-beam truss segment 802 (FIG. 8). To ensure the first truss system 200 (FIG. 2A) and second truss system 200$^2$ properly engage the I-beam truss segment 802 (FIG. 8), the arms of the second truss system 200$^2$ are shorter in length. Specifically, the length 216$^2$ of the arms in second truss system 200$^2$ are between 265 cm to 270 cm, and preferably 268.4 cm. The shorter arms results in a length 214$^2$ when measured from the top edge of the arm to the bottom edge of the connector member. The length 212$^2$ from the center of the collar to the bottom edge of the connector member is between 330 cm to 340 cm, and preferably 335 cm. The shorter arms also result in a shorter crossbar with a length 220$^2$ between 360 cm to 370 cm, and preferably of 362 cm with a 1 cm delta. The height 208$^2$ from bottom of a connector member to top of the collar is also shorter, between 178 cm to 185 cm, and preferably 181.3 cm. The height 210$^2$ from the bottom edge of the arm to the top of the collar is shorter as well, between 85 cm to 95 cm, and preferably 90 cm. Even the width 218$^2$ of the second portable modular roof truss system 200$^2$ is smaller, between 635 cm to 640 cm, and preferably 636.5 cm. However, the angle 222$^2$ of the second portable modular roof truss system 200$^2$ remains constant with the angle 222 of the first portable modular roof truss system 200 (FIG. 2A), between 130° to 140°, and preferably 134.8°. This ensures the arms in the first portable modular roof truss system 200 are parallel to the arms in the second portable modular roof truss system 200$^2$ and all four arms are capable of coupling to the I-beam truss segment 802 (FIG. 8).

FIG. 2C illustrates an isolated view of a radius and diameter of connecting members for the second portable modular roof truss system, according to an embodiment of the present invention. Both connecting members have a radius 206 between 20 cm to 30 cm, and preferably 25 cm, with a diameter 204 of preferably 50 cm.

FIG. 2D illustrates an isolated view of a diameter of a collar for the second portable modular roof truss system, according to an embodiment of the present invention. The collar of the truss system 100 has a diameter 202 between 46 cm to 56 cm, and preferably 51 cm.

Figure 3:
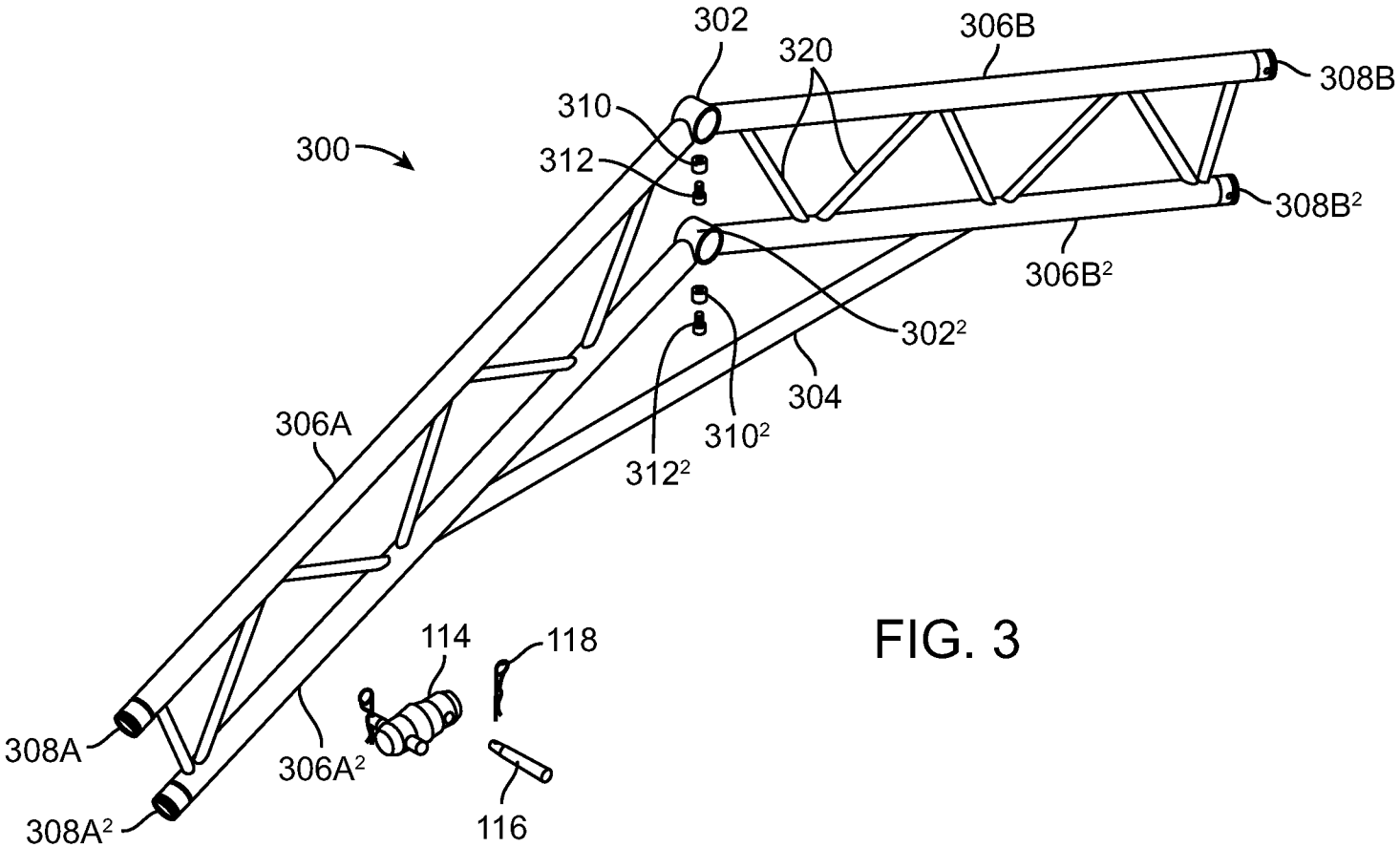
FIG. 3 illustrates a perspective view of a portable modular roof truss system, according to an embodiment of the present invention.

FIG. 3 illustrates a perspective view of a portable modular roof truss system 300, according to an embodiment of the present invention. The portable modular roof truss system 300 comprises two collars 302, 302$^2$, a crossbar 304, four arms 306A, 306A$^2$, 306B, 306B$^2$, four connecting members 308A, 308A$^2$, 308B, 308B$^2$, two locking mechanisms comprising a nut 310, 310$^2$, and bolt 312, 312$^2$, and a plurality of filler bars 320. The arms 306A, 306B, are elongated hollow cylinders coupled (e.g., welded) to opposing sides of the hollow cylindrical collar 302. Arms 306A$^2$, 306B$^2$, are elongated hollow cylinders coupled (e.g., welded) to opposing sides of the hollow cylindrical collar 302$^2$. The crossbar 304 is also an elongated cylinder residing parallel to the ground and is coupled (e.g., welded) to both arms 306A$^2$, 306B$^2$. Each hollow cylindrical connecting member 308A, 308B, 308A$^2$, 308B$^2$, is coupled (e.g., welded) to the end of an arm 306A, 306A$^2$, 306B, 306B$^2$, respectively. The nut 310 from the locking mechanism is coupled (e.g., welded) to the bottom portion of the collar 302 and interfaces an aperture in the collar 302 allowing the bolt 312 to pass through the nut 310 and into the hollow portion of the collar 302. Similarly, the nut 310$^2$ from the locking mechanism is coupled (e.g., welded) to the bottom portion of the collar 302$^2$ and interfaces an aperture in the collar 302$^2$ allowing the bolt 312$^2$ to pass through the nut 310$^2$ and into the hollow portion of the collar 302$^2$. Finally, the filler bars 320 are elongated hollow cylinders coupled (e.g., welded) to two arms 306A and 306A$^2$, or 306B and 306B$^2$.

Each connecting member 308A, 308A$^2$, 308B, and 308B$^2$ further comprises two apertures residing on opposite sides of the member perpendicular to the hollow portion thereof and used to couple the truss system 300 to a coupler 114. The connecting members 308A, 308A$^2$, 308B, and 308B$^2$ are capable of coupling to a variety of truss components (e.g., spacers, clamps, hinges, etc.).

For example, a coupler 114 may be inserted into the hollow portion of each connecting members 308A and 308A$^2$; a locking pin 116 may then be inserted through the apertures in the connecting members 308A and 308A$^2$ and in turn through an aperture in the coupler 114. In one embodiment, the locking pin 116 comprises a tapered cylinder with an aperture at smaller end capable of receiving a clasp 118. When the clasp 118 passes through the aperture in the locking pin 116, the coupler 114 is removably coupled to the portable modular roof truss system 300 at the connecting members 308A and 308A$^2$. The couplers 114 may further removably couple to additional truss components such as an I-beam truss segment 802 (FIG. 8).

Figure 4A:
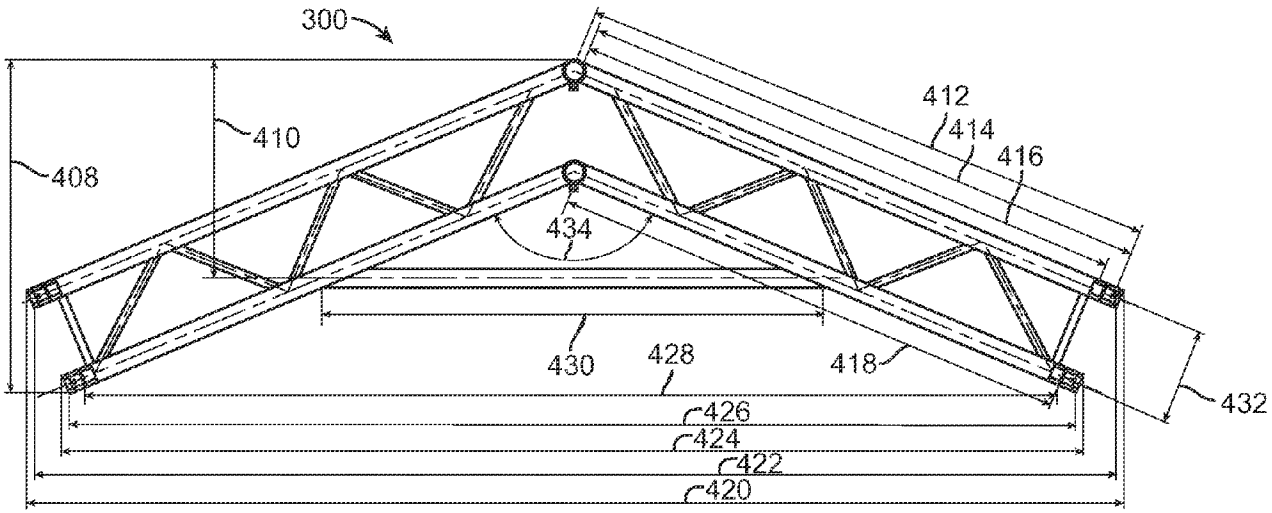
FIG. 4A illustrates a front view of the portable modular roof truss system, according to an embodiment of the present invention.

FIG. 4A illustrates a front view of a first portable modular roof truss system 300, according to an embodiment of the present invention. The height 408 of the truss system 300, when measured from the bottom edge of the connecting member to the top of the collar, is between 855 cm to 865 cm, and preferably 861.9 cm. The height 410 when measured from the center of the crossbar to the top of the collar is between 560 cm to 570 cm, and preferably 564.7 cm. The arms when coupled to connecting members and coupled to the top collar, as measured from the center of the top collar to the bottom edge of the connecting members, has a length 412 between 1525 cm to 1535 cm and preferably 1528.5 cm. The length 414 as measured from the top edge of the arms to the bottom edge of connector members is between 1508 cm to 1515 cm, and preferably 1511.7 cm. Length 416 of the arms alone is between 1457 cm and 1565 cm, and preferably 1461.7 cm. The length 418 of the bottom arms alone is between 1357 cm and 1365 cm, and preferably 1361.7 cm. The length 430 of the crossbar is between 1305 cm and 1312 cm, and preferably 1308 cm with a 1 cm delta. The width 420 of the portable modular roof truss system 300 as measured between top edges of the top connecting members is between 2834 cm and 2844 cm, and preferably 2839.6 cm. The width 422 of the portable modular roof truss system 300 as measured between bottom edges of the top connecting members is between 2795 cm to 2805 cm, and preferably 2799.5 cm. The width 424 of the portable modular roof truss system 300 as measured between top edges of the bottom connecting members is between 2650 cm to 2560 cm, and preferably 2655 cm. The width 426 of the portable modular roof truss system 300 as measured between bottom edges of the bottom connecting members is between 2615 cm to 2623 cm, and preferably 2618.8 cm. The width 428 of the portable modular roof truss system 300 as measured between bottom edges of the bottom arms is between 2520 cm and 2530 cm, and preferably 2525.4 cm. Additionally, the distance 432 between arms when measured from the midline is between 235 cm to 245 cm, and preferably 240 cm. Finally, the angle 434 as measured between the midline of both bottom arms and through the center of the bottom collar, is between 130° to 140°, and preferably 134.8°.

Figure 4B:
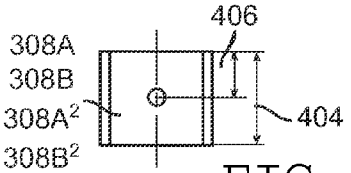
FIG. 4B illustrates an isolated view of a radius and diameter of connecting members for the modular roof truss system shown in FIG. 4A, according to an embodiment of the present invention.

FIG. 4B illustrates an isolated view of a radius and diameter of connecting members for the modular roof truss system shown in FIG. 4A, according to an embodiment of the present invention. The four connecting members have a radius 406 between 20 cm to 30 cm, and preferably 25 cm, with a diameter 404 of preferably 50 cm.

Figure 4C:
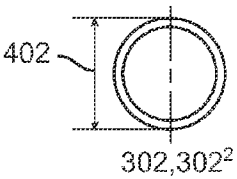
FIG. 4C illustrates an isolated view of a diameter of collars for the modular roof truss system shown in FIG. 4A, according to an embodiment of the present invention.

FIG. 4C illustrates an isolated view of a diameter of collars for the modular roof truss system shown in FIG. 4A, according to an embodiment of the present invention. The collars of the truss system 300 have a diameter 402 between 46 cm to 56 cm, and preferably 51 cm.

Figure 5:
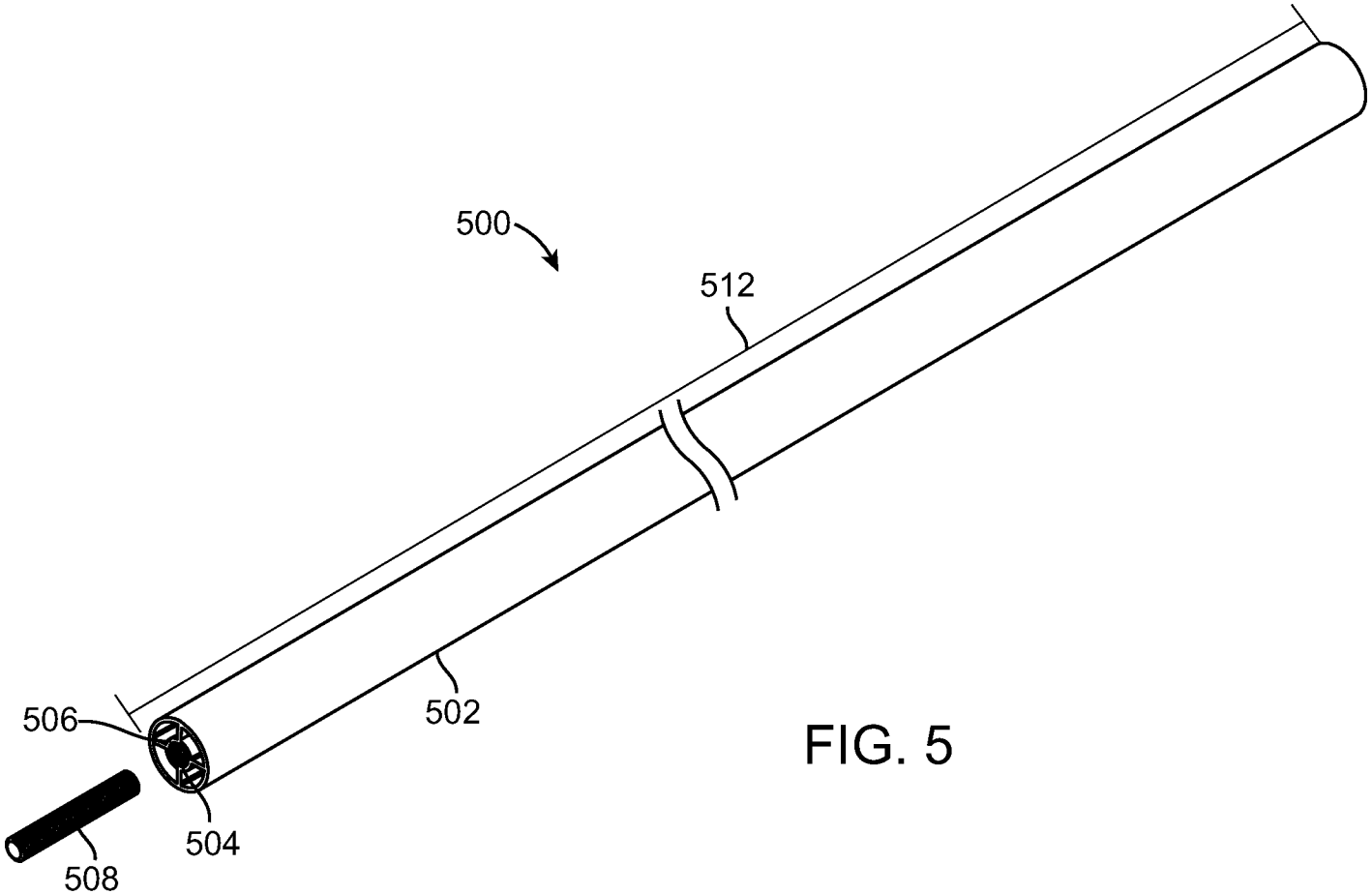
FIG. 5 illustrates a perspective view of a roof pole, according to an embodiment of the present invention.

FIG. 5 illustrates a perspective view of a roof pole 500, according to an embodiment of the present invention. The roof pole 500 of the preferred embodiment is constructed from two hollow diameter cylinders 502, 504, one within another. The two hollow cylinders are radially connected from the outside diameter of the inner cylinder 504 to the inside diameter of the outer cylinder 502 by four interconnecting radial tabs 506 which run the length of the pole 500. The inner diameter of the inner hollow cylinder 504 comprises threads to accept a bolt 508 to allow the roof poles 500 to connect one to the other and to expand the modular nature of the roof as long as is desired. The pole 500 may have a varying length 512 from 0.5 m, 1 m, 1.37 m, to 2 m. The wall thickness of the outer cylinder 502, inner cylinder 504, and radial tabs 506 is between 1 cm to 5 cm, and preferably 3 mm. Finally, the bolt 508 is preferably 16 mm in diameter. Finally, the roof pole 500 has a diameter between 45 cm to 55 cm, and preferably 50 cm.

Figure 6:
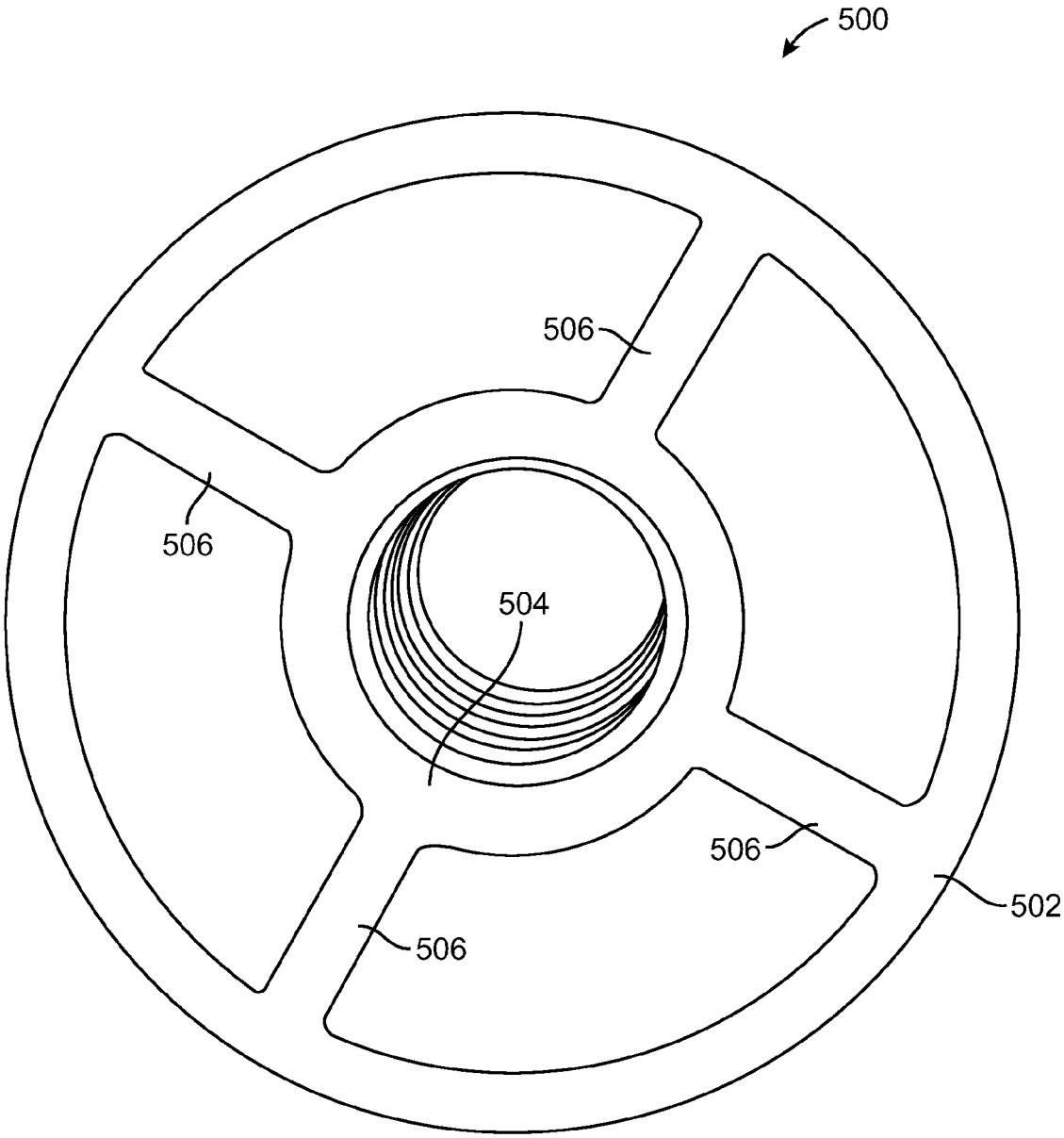
FIG. 6 illustrates a front view of the roof pole, according to an embodiment of the present invention.

FIG. 6 illustrates a front view of the roof pole 500, according to an embodiment of the present invention. This view exemplifies how the four interconnecting radial tabs 506 which run the length of the pole 500 radially connect the outer cylinder 502 and inner cylinder 504.

Figure 7:
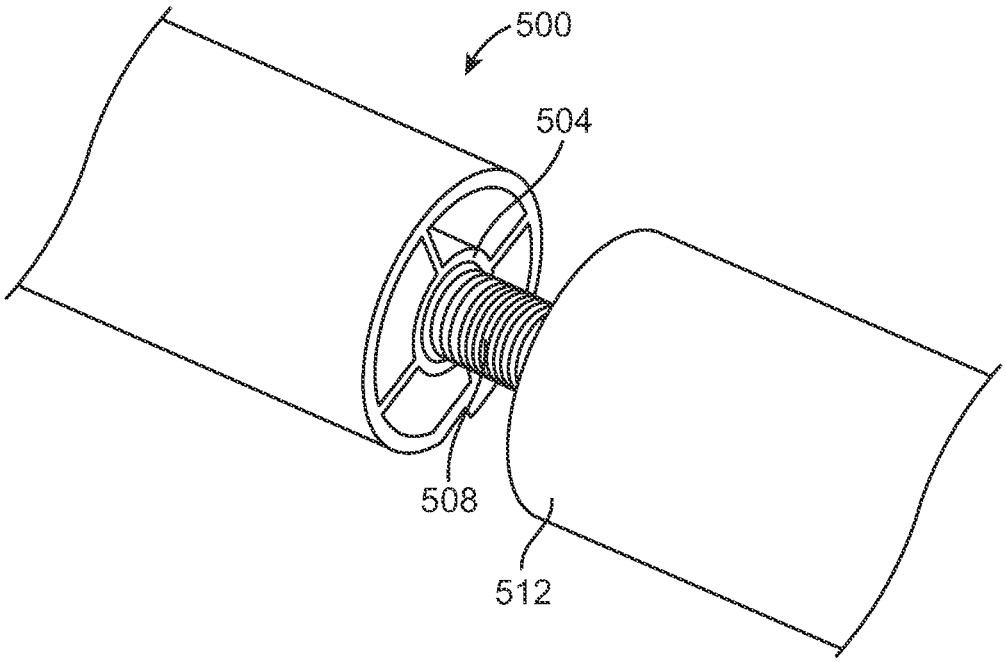
FIG. 7 illustrates two roof poles coupled together, according to an embodiment of the present invention.

FIG. 7 illustrates two roof poles 500, 512, coupled together, according to an embodiment of the present invention. In this view, the poles 500 and 512 are coupled together by utilizing the bolt 508 which engages threads residing in the inner cylinder 504 of pole 500. In an alternative embodiment, the roof poles 500 and 512 may be permanently coupled (e.g., welded) together.

FIG. 8 illustrates a view of assembled modular roof truss systems 100 and 100$^2$, according to an embodiment of the present invention. With respect to truss 100, the arms 106A, 106B, are coupled (e.g., welded) to opposing sides of the hollow cylindrical collar 102. The crossbar 104 resides parallel to the ground and is coupled (e.g., welded) to both arms 106A, 106B. Each connecting member 108A, 108B, is coupled (e.g., welded) to the end of an arm 106A, 106B, respectively. Finally, the locking mechanism is coupled (e.g., welded) to the bottom portion of the collar 102 and interfaces an aperture in the collar 102 allowing the bolt 112 to pass through the nut and into the hollow portion of the collar 102.

With respect to truss 100$^2$, the arms 106A$^2$, 106B$^2$, are coupled (e.g., welded) to opposing sides of the hollow cylindrical collar 102$^2$. The crossbar 104$^2$ resides parallel to the ground and is coupled (e.g., welded) to both arms 106A$^2$, 106B$^2$. Each connecting member 108A$^2$, 108B$^2$, is coupled (e.g., welded) to the end of an arm 106A$^2$, 106B$^2$, respectively. Finally, the locking mechanism is coupled (e.g., welded) to the bottom portion of the collar 102$^2$ and interfaces an aperture in the collar 102$^2$ allowing the bolt 112$^2$ to pass through the nut and into the hollow portion of the collar 102$^2$.

Locking members 108B and 108B$^2$ are removably coupled to an I-beam truss segment 802 as evidenced by locking pins 116 and clasps 118. Similarly, locking members 108A and 108A$^2$ are coupled to an I-beam truss segment 802 by use of locking pins 116 and clasps 118.

A roof pole 500 passes through the hollow cylindrical collar 102 of the truss system 100 (i.e., through the first opening 103A and second opening 103B). Said roof pole 500 may pass through a plurality of modular roof truss systems to create a roof of desired length. To ensure the roof pole 500 does not move back and forth through the collar 102, the bolt 112 is threaded through the collar 102 and pushes against the bottom of the roof pole 500. The top of the roof pole 500 in turn pushes against the collar 102 creating sufficient friction so the roof pole 500 cannot move laterally in relation to the collar 102.

Also exemplified in FIG. 8 is roof pole 500$^2$ passing through the hollow cylindrical collar 102$^2$ of the second truss system 100$^2$. Said roof pole 500$^2$ may also pass through a plurality of modular roof truss systems to create a roof of desired length. As with truss 100, to ensure the roof pole 500$^2$ does not move back and forth through the collar 102$^2$, the bolt 112$^2$ is threaded through the collar 102$^2$ and pushes against the bottom of the roof pole 500$^2$. The top of the roof pole 500$^2$ in turn pushes against the collar 102$^2$ creating sufficient friction so the roof pole 500$^2$ cannot move laterally.

Figure 9:
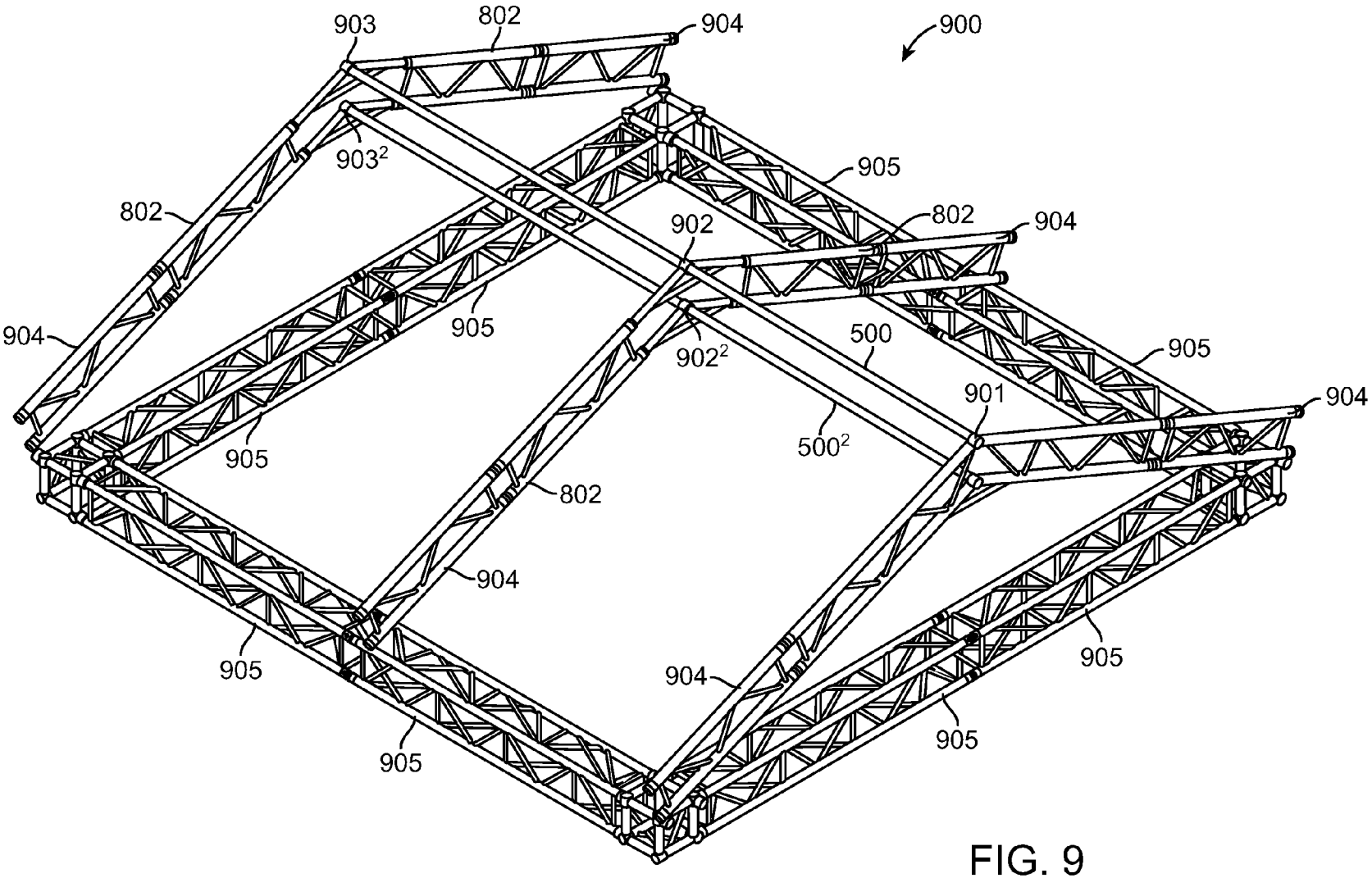
FIG. 9 illustrates an alternative view of assembled roof truss, according to an embodiment of the present invention.

FIG. 9 illustrates an alternative view of assembled roof truss 900, according to an embodiment of the present invention. The assembled system 900 comprises truss system 901 and first modular roof truss systems 902, and 903. The system 900 further comprises second modular roof truss systems 902$^2$, and 903$^2$. Each pair of modular truss systems: 902 and 902$^2$; 903 and 903$^2$; are coupled to two I-beam truss segments 802, whereas truss system 901 couples to two secondary I-beam truss segments 904. Each I-beam truss segment 802 is further coupled a secondary I-beam truss segment 904. Finally, each secondary I-beam truss segment 904 is coupled to a square truss segment 905. Roof pole 500 passes through and connects the truss system 901 with first modular roof truss systems 902, and 903; while roof pole 500$^2$ passes through and connects the truss system 901 with the second modular roof truss systems 902$^2$, and 903$^2$.

The modular roof truss systems 901, 902, and 903, all being identical in shape provide a uniform slope for the assembled modular roof truss 900. In one embodiment of the present invention, fabric (e.g., spandex, cotton, etc.) is stretched over the first modular roof truss systems 901, 902, and 903, roof pole 500, and I-beam truss segments 802 and 904, to create a roof having symmetrical slopes. Each pair of modular truss systems: 902 and 902$^2$; 903 and 903$^2$; are interchangeable with the truss system 901, and vice versa.

The elements of the modular roof truss systems 100 (FIG. 1), 300 (FIG. 3), may be made of rigid materials such as metals and the like. Preferably, the elements of the modular roof truss systems 100 (FIG. 1), 300 (FIG. 3) comprise extruded aluminum.

The present invention has been described in considerable detail with reference to certain preferred versions thereof; however, other versions are possible. Therefore, the spirit and scope of the appended claims should not be limited to the description of the preferred versions contained herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A portable modular roof truss system, comprising:

a first roof truss apex device, comprising:

a first hollow apex collar including a first open end and a second open end, wherein the first open end of the first hollow apex collar receives a first roof pole that passes through the first open end and the second open end through a hollow portion of the apex collar;

a first elongated arm with one end transversely coupled to a first side of the first hollow apex collar;

a second elongated arm with one end transversely coupled to a second side located away from the first side of the first hollow apex collar;

an elongated crossbar residing in a plane parallel to a surface on which the portable modular roof truss system is installed, below the first hollow apex collar, and coupled to both the first and second elongated arms; and a second roof truss apex device residing in a plane both parallel to and below the first roof truss apex device;

wherein the first and second elongated arms slope downwards away from the first hollow apex collar;

wherein the first roof truss apex device engages two truss segments sloping downwards away from the first hollow apex collar.

2. The system of claim 1, wherein the first roof truss apex device further comprises:

a first hollow connecting member coupled to an opposite distal end of the first elongated arm; and a second hollow connecting member coupled to an opposite distal end of the second elongated arm;

wherein the first and second connecting members receive and engage an I-beam truss segment.

3. The system of claim 2, wherein the first roof truss apex device further comprises:

a locking mechanism at the first hollow apex collar that engages and prevents the first roof pole from moving within the first hollow apex collar.

4. The system of claim 3, wherein the second roof truss apex device comprises:

a second hollow apex collar including a first open end, wherein the first open end of the second hollow apex collar receives a second roof pole;

a third elongated arm with one end transversely coupled to a first side of the second hollow apex collar;

a fourth elongated arm with one end transversely coupled to a second side located away from the first side of the second hollow apex collar;

a second elongated crossbar residing horizontally below the second hollow apex collar and coupled to both the third and fourth elongated arms;

wherein the third and fourth elongated arms slope downwards away from the second hollow apex collar;

wherein the second roof truss apex device engages two truss segments sloping downwards away from the second hollow apex collar.

5. The system of claim 4, wherein the second roof truss apex device further comprises:

a third hollow connecting member coupled to an opposite distal end of the third elongated arm; and a fourth hollow connecting member coupled to an opposite distal end of the fourth elongated arm;

wherein the third and fourth connecting members couple to the I-beam truss segment.

6. The system of claim 5, wherein the second roof truss apex device further comprises:

a second locking mechanism at the second hollow apex collar that engages and prevents the second roof pole from moving within the second hollow apex collar.

7. The system of claim 6, wherein the second roof pole resides in a plane both parallel to and directly below the first roof pole.

8. The system of claim 7, wherein the first and second roof poles reside in a plane perpendicular to the first and second roof truss apex devices.

9. The system of claim 8, wherein the third elongated arm resides in a plane both parallel to and directly below the first elongated arm.

10. The system of claim 9, wherein the fourth elongated arm resides in a plane both parallel to and directly below the second elongated arm.

11. The system of claim 10, wherein each hollow apex collar, each elongated arm, and each elongated crossbar is cylindrical in shape.

12. The system of claim 1, wherein the first elongated arm and the second elongated arm each include one end transversely coupled to the first open end and a second open end of the first hollow apex collar.

13. A portable modular roof truss system, comprising:

a first hollow apex collar that includes a first open end, wherein the first open end of the first hollow apex collar receives a first roof pole;

a second hollow apex collar that includes a first open end, wherein the first open end of the second hollow apex collar receives a second roof pole;

a first elongated arm with one end transversely coupled to a first side of the first hollow apex collar;

a second elongated arm with one end transversely coupled to a second side located away from the first side of the first hollow apex collar;

a third elongated arm with one end transversely coupled to a first side of the second hollow apex collar;

a fourth elongated arm with one end transversely coupled to a second side located away from the first side of the second hollow apex collar; and an elongated crossbar residing horizontally below the second hollow apex collar and coupled to both the third and fourth elongated arms;

wherein the first and second elongated arms slope downwards away from the first hollow apex collar;

wherein the third and fourth elongated arms slope downwards away from the second hollow apex collar;

wherein the second hollow apex collar resides in a plane directly below the first hollow apex collar; and wherein the system engages two truss segments sloping downwards away from each of the first hollow apex collar and the second hollow apex collar.

14. The system of claim 13, further comprising:

a first hollow connecting member coupled to an opposite distal end of the first elongated arm; and a second hollow connecting member coupled to an opposite distal end of the second elongated arm;

wherein the first and second connecting members receive and engage an I-beam truss segment.

15. The system of claim 14, further comprising:

a locking mechanism at the first hollow apex collar that engages and prevents the first roof pole from moving within the first hollow apex collar.

16. The system of claim 15, further comprising:

a third hollow connecting member coupled to an opposite distal end of the third elongated arm; and a fourth hollow connecting member coupled to an opposite distal end of the fourth elongated arm;

wherein the third and fourth connecting members receive and engage the I-beam truss segment.

17. The system of claim 16, further comprising:

a second locking mechanism at the second hollow apex collar that engages and prevents the second roof pole from moving within the second hollow apex collar.

18. The system of claim 17, further comprising:

a plurality of first filler bars comprising:

a first end coupled to the first elongated arm;

a second end coupled to the third elongated arm; and a plurality of second filler bars comprising:

a first end coupled to the second elongated arm; and a second end coupled to the fourth elongated arm.

19. The system of claim 18, wherein the plurality of first filler bars are arranged in a zig zag pattern between the first and third elongated arms; and wherein the plurality of second filler bars are arranged in a zig zag pattern between the second and fourth elongated arms.

20. The system of claim 19, wherein the second roof pole resides in a plane both parallel to and directly below the first roof pole.

21. The system of claim 20, wherein the first and second roof poles reside in a plane perpendicular to the first and second elongated arms.

22. The system of claim 21, wherein the third elongated arm resides in a plane both parallel to and directly below the first elongated arm.

23. The system of claim 22, wherein the fourth elongated arm resides in a plane both parallel to and directly below the second elongated arm.

24. The system of claim 23, wherein each hollow apex collar, arm, each elongated crossbar, and each filler bar is cylindrical in shape.

25. A portable modular roof truss system, comprising:

a first roof truss apex device, comprising:

a first hollow cylindrical apex collar including a first open end and a second open end, wherein the first open end of the first hollow cylindrical apex collar receives a first roof pole that passes through the first hollow cylindrical apex collar and through the second open end;

a first elongated arm with one end transversely coupled to a first side of the first hollow cylindrical apex collar;

a second elongated arm with one end transversely coupled to a second side located away from the first side of the first hollow cylindrical apex collar;

an elongated crossbar residing in a plane parallel to a surface on which the portable modular roof truss system is installed, below the first hollow cylindrical apex collar, and directly coupled to both the first and second elongated arms;

wherein the first and second elongated arms are coupled to the first hollow cylindrical apex at a predetermined slope, and wherein the first and second elongated arms each slope downwards away from the first hollow cylindrical apex collar.

26. A portable modular roof truss system, comprising:

a first roof truss apex device, comprising:

a first hollow apex collar including a first open end and a second open end, wherein a first roof pole is coupled through the first open end and the second open end through a hollow portion of the apex collar;

a first elongated arm with one end transversely coupled to a first side of the first hollow apex collar; and a second elongated arm with one end transversely coupled to a second side located away from the first side of the first hollow apex collar; and a second roof truss apex device, comprising:

a second hollow apex collar including a first open end, wherein the first open end of the second hollow apex collar receives a second roof pole, wherein the first elongated arm and the second elongated arm are coupled to a third elongated arm and a fourth elongated arm of the second hollow apex collar using a plurality of filler bars.

27. The system of claim 26, wherein the third elongated arm has one end transversely coupled to a first side of the second hollow apex collar; and the fourth elongated arm has one end transversely coupled to a second side located away from the first side of the second hollow apex collar.

* * * * *